US007267577B2

(12) United States Patent
Nakano et al.

(10) Patent No.: US 7,267,577 B2
(45) Date of Patent: Sep. 11, 2007

(54) CONNECTOR TO BE MOUNTED ON AN ELECTRIC/ELECTRONIC DEVICE

(75) Inventors: Hiroshi Nakano, Yokkaichi (JP); Kenji Okamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/435,591

(22) Filed: May 17, 2006

(65) Prior Publication Data

US 2006/0264097 A1 Nov. 23, 2006

(30) Foreign Application Priority Data

May 20, 2005 (JP) ..... 2005-148036

(51) Int. Cl.
*H01R 13/60* (2006.01)

(52) U.S. Cl. ..... 439/570

(58) Field of Classification Search ..... 439/566, 439/570

See application file for complete search history.

(56) References Cited

U.S. PATENT DOCUMENTS 5,120,256 A * 6/1992 Walden ..... 439/553
5,259,789 A 11/1993 Patel et al.
5,318,464 A * 6/1994 DiMondi et al. ..... 439/553
6,129,589 A 10/2000 Simmel et al.
6,478,617 B2 * 11/2002 Fan ..... 439/570
6,645,005 B2 * 11/2003 Wu ..... 439/563
6,699,069 B2 3/2004 Inoue
7,001,212 B1 * 2/2006 Juntwait ..... 439/566
7,048,576 B2 * 5/2006 Nakano ..... 439/570
7,074,079 B2 * 7/2006 Higuchi ..... 439/566
2004/0175978 A1 9/2004 Mugiuda et al.
2005/0026481 A1 2/2005 Nishio et al.
2005/0124228 A1 6/2005 Nakano et al.
2006/0121780 A1 6/2006 Nakano

FOREIGN PATENT DOCUMENTS

JP 61-60486 4/1986

* cited by examiner

*Primary Examiner*—Briggitte Hammond
*Assistant Examiner*—Larisa Tsukerman
(74) *Attorney, Agent, or Firm*—Gerald E. Hespos; Anthony J. Casella

(57) ABSTRACT

A circuit board connector has metal fixing portions (60) for fixing a synthetic resin housing (10) to a circuit board (K). The fixing portions (60) are mounted into the housing (10) and are soldered to the circuit board (K). The housing (10) has mounting grooves (15) for receiving the fixing portions (60), whereas the fixing portions (60) have retaining portions (67) for biting in edges of the mounting grooves (15) to prevent the fixing portions (60) from coming out of the mounting grooves (15). Contact positions of the retaining portions (67) and edges of the mounting grooves (15) are lower than half the maximum height (L1) of the housing (10) for keeping the fixing portions (60) solder-connected with the circuit board (K) against a separating force on the fixing portions (60) in a direction away from the circuit board (K) as the housing (10) thermally expands.

15 Claims, 7 Drawing Sheets

CONNECTOR TO BE MOUNTED ON AN ELECTRIC/ELECTRONIC DEVICE

BACKGROUND OF THE INVENTION

1. Field of the Invention

The invention relates to a connector to be mounted on an electric or electronic device, such as a circuit board connector.

2. Description of the Related Art

Japanese Unexamined Utility Model Publication No. S61-60486 discloses a circuit board connector with a housing that is connectable with a mating connector. Terminal fittings penetrate the back wall of the housing so that front parts of the terminal fittings project inside the housing and rear parts are exposed outside the housing. The rear parts are bent towards a circuit board and rear ends of the terminal fittings are soldered to the circuit board.

Fixing portions bulge out at the bottom ends of the opposite side surfaces of the housing and screws are driven into internally threaded holes in the fixing portions to fix the housing to the circuit board. The fixing portions must have sufficient strength to bear a screw driving force, and hence the fixing portions tend to be large.

Consideration has been given to forming the fixing portions of metal and then soldering the metal fixing portions the circuit board. The metal fixing portions then could be smaller. However, reflow soldering generates significant heat and causes the entire housing to expand thermally. Thus, a separating force acts on the fixing portions in a direction away from the circuit board and could cause the fixing portions to become unsoldered. Lead-free solder has become widely used for environmental reasons. However, lead free solder has a high melting point and requires the housing to pass through a reflow furnace for a long time at high temperatures. Therefore, the influence of the thermal expansion of the housing on the fixing portions cannot be ignored.

The invention was developed in view of the above problem, and an object thereof is to satisfactorily keep a connected state of fixing portions.

SUMMARY OF THE INVENTION

The invention relates to a connector mountable on an electric or electronic device, such as a printed circuit board. The connector includes a housing with at least one fixing portion for fixing the housing to the electric or electronic device. The fixing portion is a metal plate that is mounted to the housing and then connected with the electric or electronic device by soldering. Displacement restricting means are provided between the housing and the fixing portion for keeping the fixing portion soldered to the electric or electronic device against a separating force that acts on the fixing portion in a direction away from the electric or electronic device as the housing thermally expands.

The fixing portion preferably has a retainer for biting in an edge of the housing to prevent the fixing portion from separating from the housing.

The housing preferably is formed with a mounting groove for receiving the fixing portion. The retainer of the contact portion preferably contacts an edge of the mounting groove at a contact position that comprises at least part of the displacement restricting means.

An upper part of the housing with respect to the height direction is farther from the circuit board than a lower part and hence displaces more in response to thermal expansion.

The contact position of the retainer and the mounting groove preferably is near the electric or electronic device. Accordingly, the displacement of the contact position is small.

The displacement restricting means preferably comprises at least one lock on the housing and at least one engaging portion on the fixing portion. The engaging portion engages the lock to lock the fixing portion to the housing.

The engaging portion and the lock preferably engage only at one position for each fixing portion. Accordingly, a contact area of the fixing portion with the housing is low, and the influence of the thermal expansion of the housing on the fixing portion is low.

The engaging portion and the lock preferably are at the widthwise center of the fixing portion. Accordingly, the fixing portion is balanced.

The engaging portion preferably is a locking hole in the fixing portion and the lock preferably is a locking projection that fits into the locking hole. The locking projection expands by the thermal expansion of the housing and is held in close contact with the inner surface of the locking hole. Therefore, the fixing portion can be locked into the housing with an enhanced force.

The fixing portion preferably becomes gradually larger towards a rear part as seen in a mounting direction of the fixing portion to the housing.

The housing preferably is made of a synthetic resin that has a high heat resistance, such as a liquid crystal polymer or a polyphenylene sulfide.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
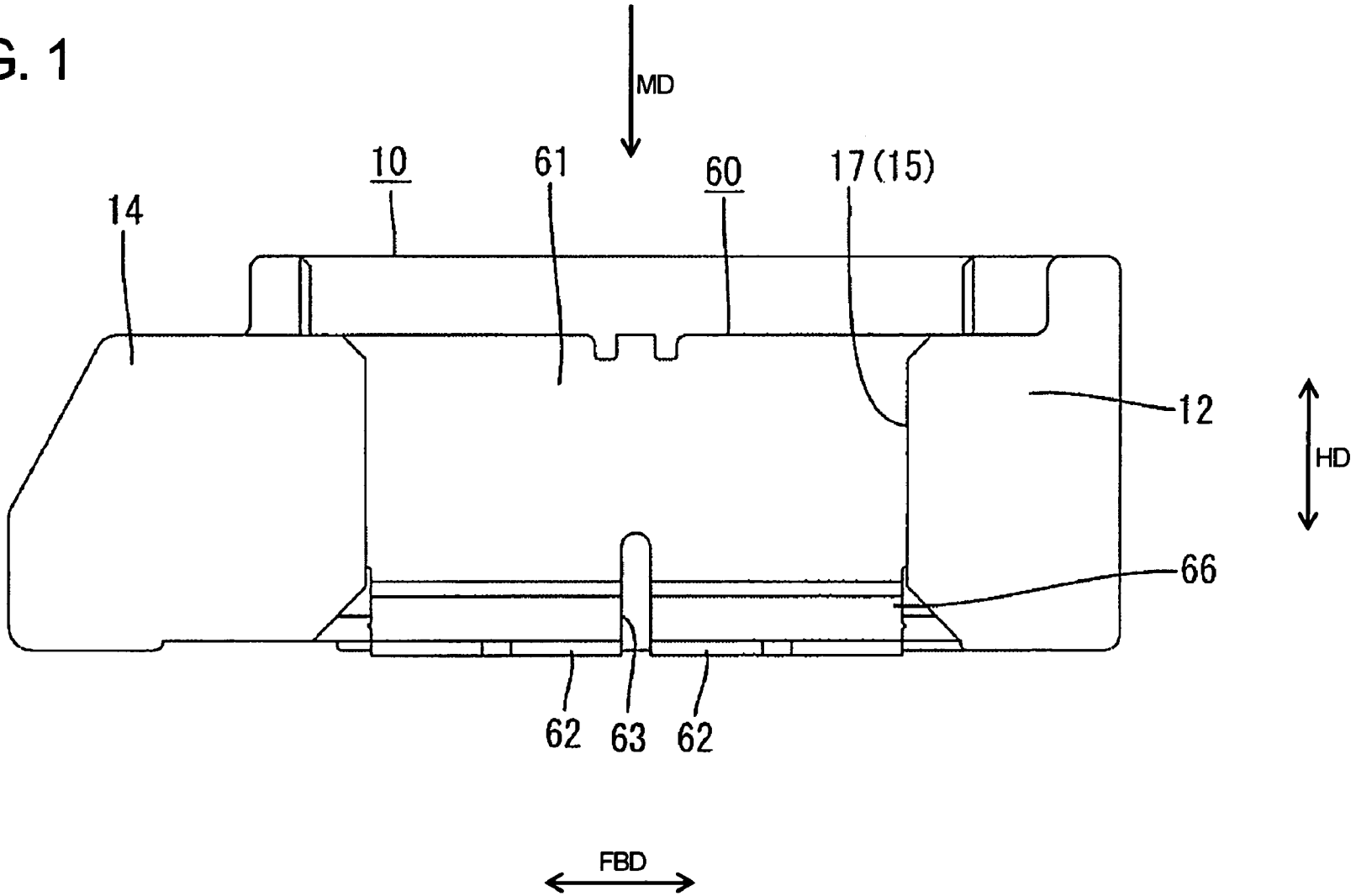
FIG. 1 is a side view of a circuit board connector according to a first embodiment.
Figure 2:
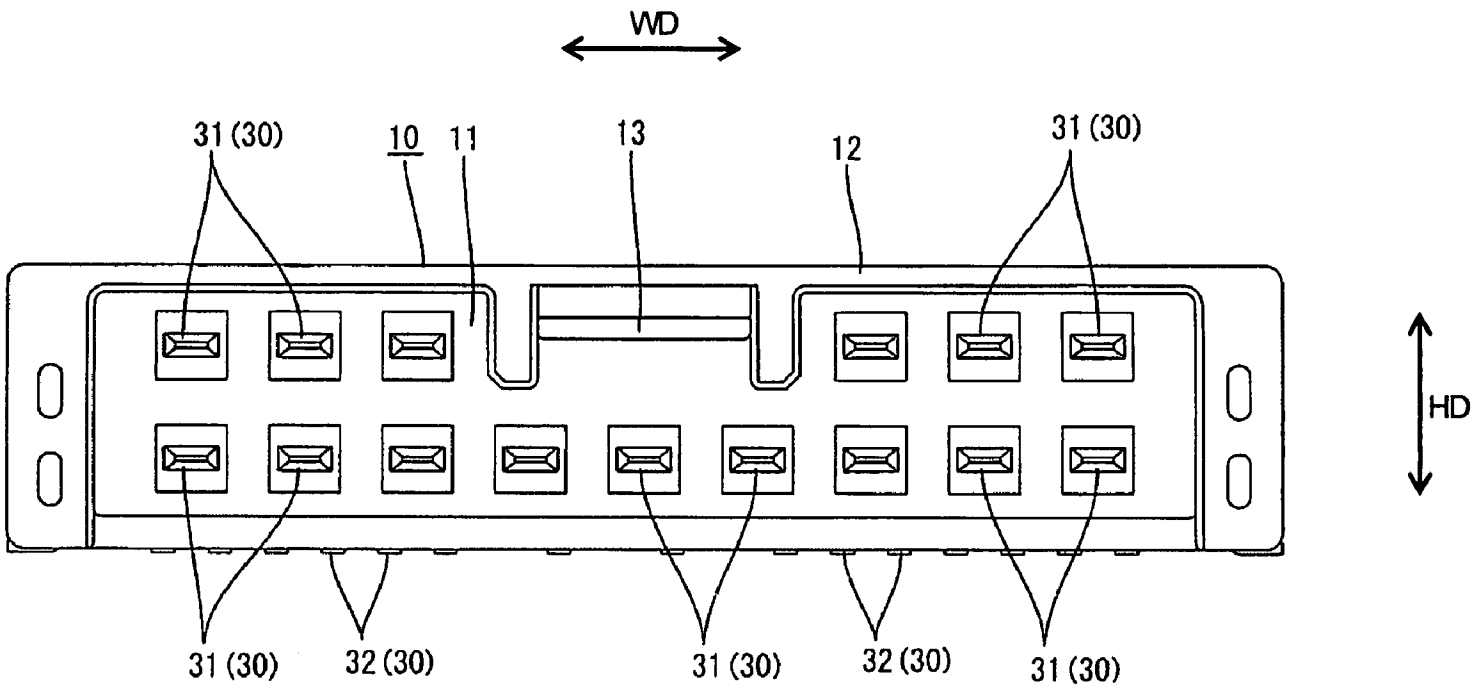
FIG. 2 is a front view of the circuit board connector.
Figure 3:
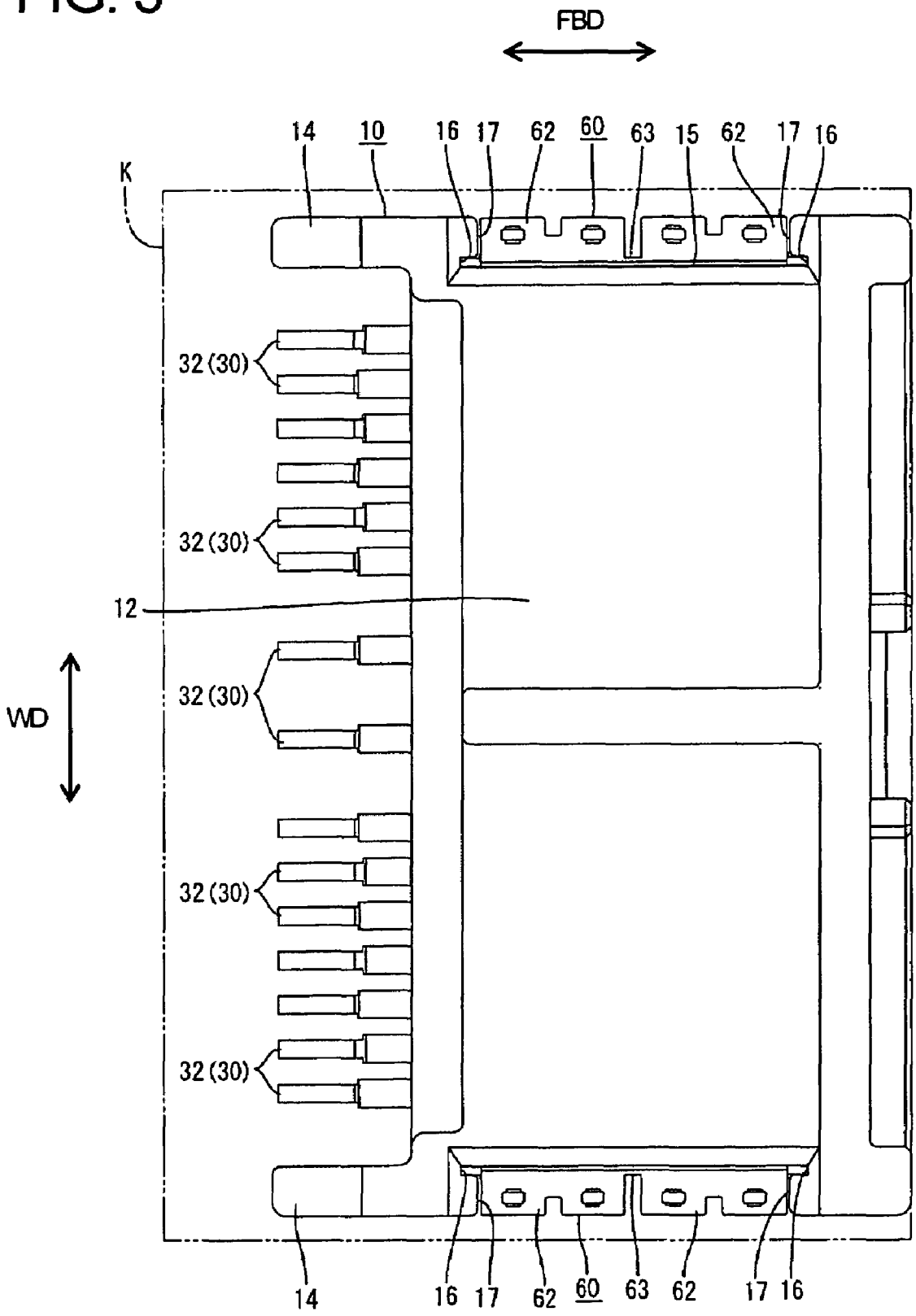
FIG. 3 is a plan view of the circuit board connector.
Figure 4:
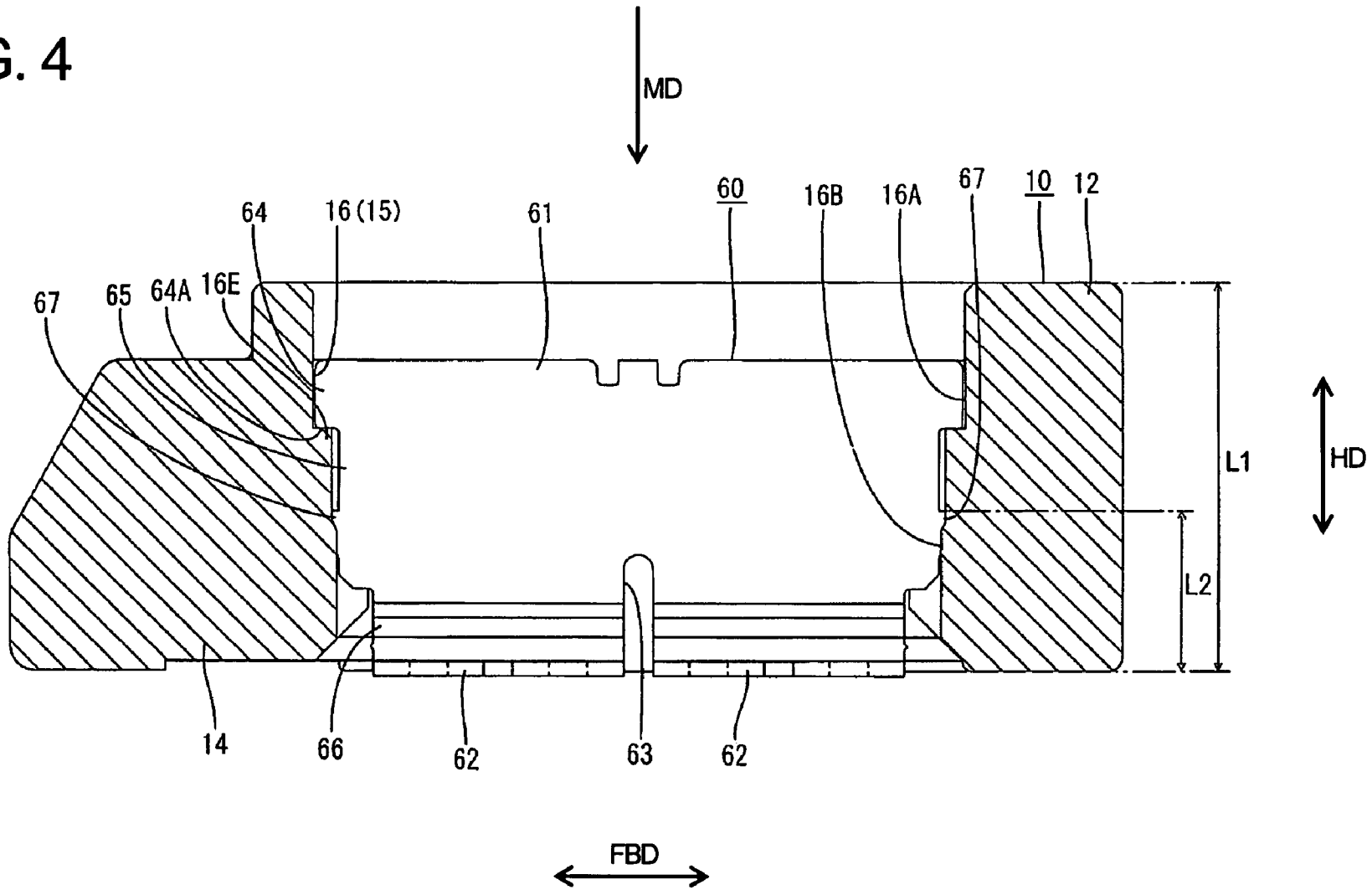
FIG. 4 is a side view in section of the circuit board connector.

A circuit board connector according to first embodiment of the invention is described with reference to FIGS. 1 to 4. The connector of this embodiment has a housing 10 that is to be connected with an unillustrated mating housing. Terminal fittings 30 are mounted in the housing 10 and fixing portions 60 are mounted on the housing 10 for fixing the housing 10 to a circuit board K. An end of the housing 10 that is to be connected with the mating connector is referred to herein as the front, and all of the Figures except FIG. 3 are oriented in the vertical direction.

The housing 10 is made e.g. of a synthetic resin having a high heat resistance such as an LCP (liquid crystal polymer) or a PPS (polyphenylene sulfide). More particularly, the housing 10 has a wide terminal holding portion 11 for holding the terminal fittings 30 and a receptacle 12 projects forward from the peripheral edge of the terminal holding portion 11 as shown in FIG. 2.

The terminal holding portion 11 is formed with terminal insertion holes (not shown) and the terminal fittings 30 can be pressed into the terminal insertion holes from behind. The terminal fittings 30 inserted into the terminal insertion holes are arranged at upper and lower stages while being juxtaposed along a width direction WD and a height direction HD that is normal to the width direction WD. Three terminal fittings 30 are arranged at each of the left and right sides of the upper stage, whereas nine terminals 30 are arranged at substantially even intervals along width direction WD at the lower stage. Protection walls 14 project back at the opposite left and right sides of the terminal holding portion 11 for protecting the terminal fittings 30 exposed at the rear surface of the terminal holding portion 11.

The receptacle 12 is a wide substantially rectangular tube having an open front for receiving the mating housing from the front. The upper and lower walls of the receptacle 12 are thinner than those of the terminal holding portion 11 to reduce the height of the housing 11. A lock projection 13 is formed substantially in the widthwise center of the upper wall of the receptacle 12 and is engageable with an engaging portion of the mating housing to hold the two housings connected. Two mounting grooves 15 are formed in the opposite side walls of the receptacle 12 for receiving the corresponding fixing portions 60.

The terminal fittings 30 penetrate the terminal holding portion 11. Connector-side connecting portions 31 are formed at the front ends of the terminal fittings 30 and are arranged substantially horizontally in the receptacle 12. The connector-side connecting portions 31 are connectable with mating terminals in the mating housing. Rear portions of the terminal fittings 30 are exposed at the rear of the terminal holding portion 11. More particularly, the rear portions of the terminal fittings 30 are bent at specified positions and extend down substantially at right angles to the connector-side connecting portions 31, and bottom ends thereof are bent again at substantially right angles to define board-side connecting portions 32 that extend backward. The board-side connecting portions 32 are connectable by reflow soldering with conductor paths printed on the circuit board K. Upper and lower terminal fittings 30 at adjacent stages are displaced along the width direction WD so that the board-side connecting portions 32 are arranged at substantially even intervals on the same straight line along the width direction WD. Thus, the rear ends of the board-side connecting portions 32 are aligned at substantially the same position with respect to forward and backward directions FBD.

Each fixing portion 60 is formed separate from the housing 10 by punching or cutting a metal sheet into a specified shape and then bending the cut or punched metal sheet into a substantially L-shape. More specifically, the fixing portion 60 has a main body 61 in the form of a substantially flat plate extending substantially along the height direction HD and a solder portion 62 that projects sideways and substantially normal to the main portion 61 from a bottom end 66 of the main portion 61. A slit 63 is formed in the fixing portion 60 in an intermediate position with respect to the width direction of the fixing portion 60. The slit 63 extends from the solder portion 62 to an intermediate position along the height direction HD of the main portion 61. The solder portion 62 is divided into front and rear areas at the slit 63. One of the front and rear areas could have a poor throwing power due to the thermal expansion of the housing 10. However, the slit 63 reduces the influence of thermal expansion on the other side.

Each mounting groove 15 extends substantially in the height direction HD and opens in both upper and lower surfaces of the housing 10. Each mounting groove 15 has a main-portion accommodating groove 16 for receiving the opposite lateral edges of the main portion 61, and a solder-portion accommodating groove 17 for receiving the solder portion 62.

The main portion 61 of each fixing portion 60 has a stepped shape with three widths defining a wide upper end 64, an intermediate portion 65 that is narrower than the upper end 64 and a bottom end 66 that is narrower than the intermediate portion 65. The solder portion 62 has substantially the same width as the bottom end 66 to which it is coupled. On the other hand, each main-portion accommodating groove 16 of the mounting groove 15 has a wide portion 16A that is at least as wide as the upper end 64 of the main portion 61 and a narrow portion 16B that is at least as wide as the intermediate portion 65 of the main portion 61. The wide and narrow portions 16A and 16B are connected one above the other. The solder-portion accommodating groove 17 is at least as wide as the bottom end 66 of the main portion 61 and the solder portion 62.

Steps 64*a* at the bottom of the upper end 64 contact steps 16E at the bottom end of the wide portion 16A when the fixing portion 60 is inserted into the mounting groove 15. Thus, the fixing portion 60 is positioned with respect to the housing 10. In this mounted state, specified clearances are defined between the bottom end 66 of the main portion 61 and the narrow portion 16B.

Two retaining portions 67 bulge out sideways at the opposite lateral edges of the intermediate portion 65 of the main portion 61. The retaining portions 67 bite in and engage the edges of the narrow portion 16B of the main-body accommodating groove 16 to hold the fixing portion 60 in the mounting groove 15. A projecting distance of the solder portion 62 to the lateral side substantially equals the depth of the solder-portion accommodating groove 17. Thus, the projecting end of the solder portion 62 is substantially flush with the outer side surface of the housing 10 in the mounted state.

The contact positions of the retaining portions 67 with the edges of the mounting groove 15 in the mounted state are spaced from the circuit board K by a distance L2 that is less than half the maximum height L1 of the housing 10 in the height direction HD of the housing 10 away from the circuit board K. Thus, these contact positions are in an area of the housing 10 that thermally expands smaller distances away from the housing 10, and the solder portions 62 can be held soldered against a separating force away from the circuit board K as the housing 10 thermally expands.

The terminal fittings 30 are inserted into the corresponding terminal insertion holes of the housing 10 from behind. The fixing portions 60 then are inserted into the respective mounting grooves 15 of the housing 10 from above and along a mounting direction MD that is substantially parallel to the height direction HD and substantially along the plate surfaces of the main portions 61. Thus, the main portions 61 are inserted into the main-portion accommodating grooves 16 and the solder-portions 62 are inserted into the solder-portion accommodating grooves 17. The mounting operation can be carried out using an unillustrated jig.

The intermediate portions 65 are moved down along the mounting direction MD in the narrow portions 16B so that the retaining portions 67 bite in the groove edges of the narrow portions 16B. The steps 64A of the upper end portions 64 contact the steps 16E of the wide portions 16A to prevent any further insertion of the fixing portions 60. In this state, the retaining portions 67 are at the contact positions spaced from the circuit board K by a distance L2 that is less than half the maximum height L1 of the housing 10, and bite in the groove edges of the narrow portions 16B at the contact positions. Thus, the fixing portions 60 are prevented from coming out. It should be noted that the terminal fittings 30 may be mounted after the fixing portions 60 are mounted.

Solder is applied to lands on the circuit board K. The housing 10 then is placed on the circuit board K so that the board-side connecting portions 32 of the terminal fittings 30 and the solder portions 62 of the fixing portions 60 contact the corresponding lands. The circuit board K having the housing 10 mounted thereon then is moved through a reflow furnace (not shown) that melts the solder to adhere the board-side connecting portions 32 and the solder portions 62 to the corresponding lands. The solder then is cooled and solidified. Thus, the terminal fittings 30 are connected electrically with the conductor paths of the circuit board K and the fixing portions 60 are fixed to the circuit board K.

The heat in the reflow furnace will cause the housing 10 to expand thermally. However, the housing 10 is made of the resin having a high heat resistance. Thus, the thermal expansion of the housing 10 can be held down even in a heated environment. The housing 10 travels in the reflow furnace for a long time at a high temperature if a lead-free solder is used. Therefore, the influence of the thermal expansion of the housing 10 is extended to the fixing portions 60 and a separating force acts on the fixing portions 60 in a direction away from the circuit board K.

In this respect, the contact positions of the retaining portions 67 with the groove edges of the mounting grooves 15 are spaced from the bottom of the housing 10 by a distance L2 that is less than half the maximum height L1 of the housing 10 along the height direction HD. Thus, an amount of thermal displacement can be held down without accumulating amounts of displacement resulting from the thermal expansion from the side of the circuit board K. As a result, thermal displacement of the fixing portions 60 is small and the fixing portions 60 will not separate from the circuit board K.

Figure 5:
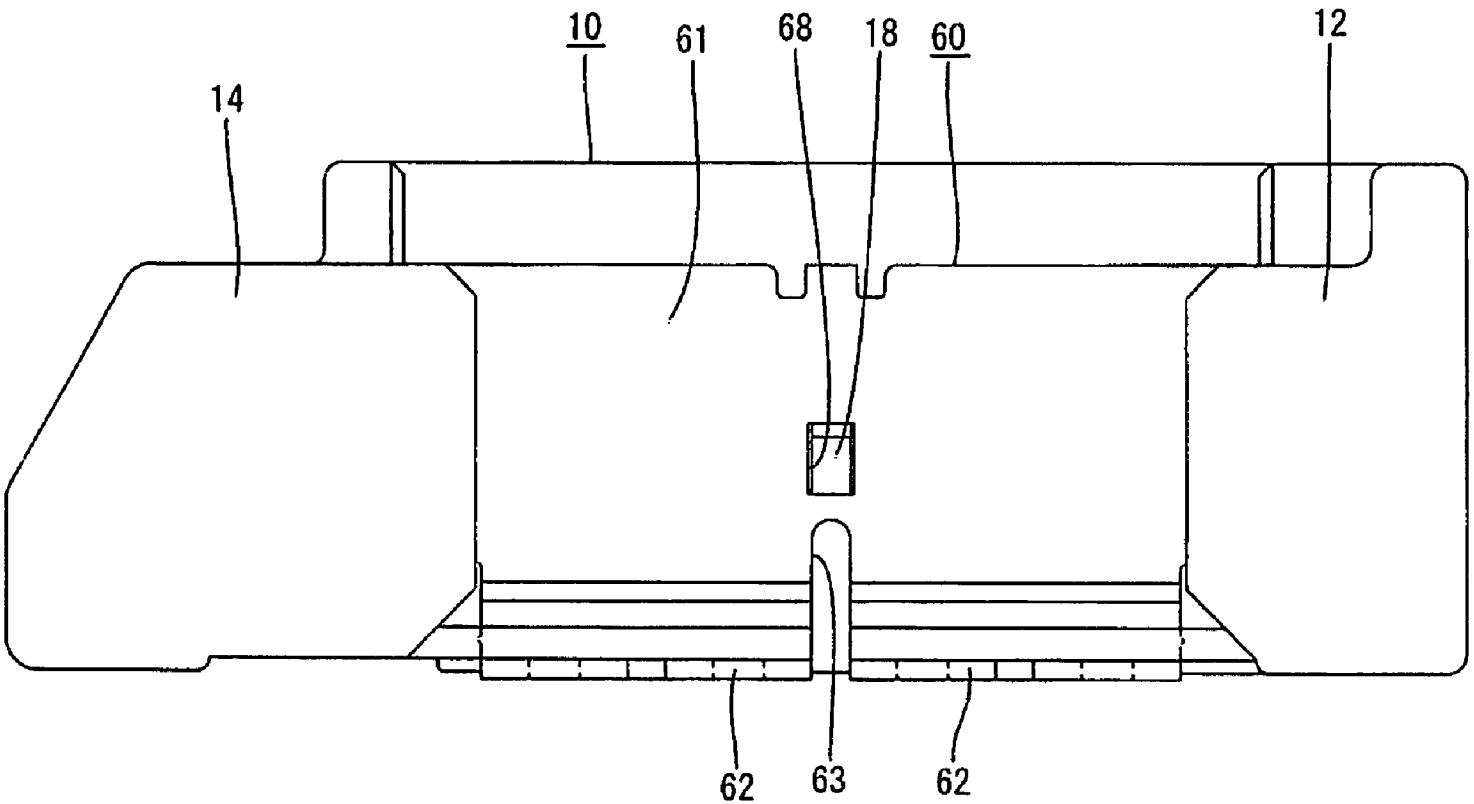
FIG. 5 is a side view of a circuit board connector according to a second embodiment.
Figure 6:
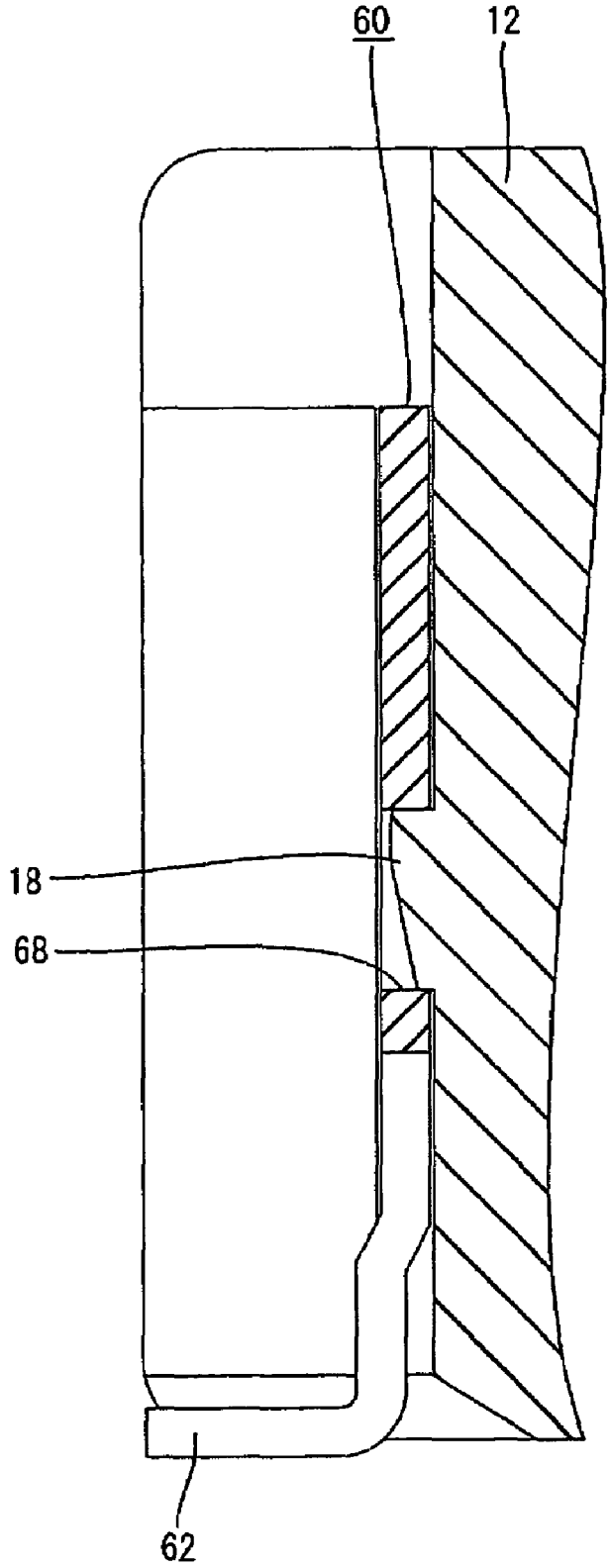
FIG. 6 is a vertical section enlargedly showing a portion of the circuit board connector of FIG. 5.

A second embodiment of the invention is described with reference to FIGS. 5 and 6. In the second embodiment, the displacement restricting means is changed and the forms of the fixing portions 60 and the mounting grooves 15 differ those of the first embodiment. Others parts are similar to or the same as the first embodiment. These similar parts are identified by the same reference numerals, but are not described again.

A locking hole 68 penetrates the main portion 61 of each fixing portion 60 substantially in the center of the main portion 61 of with respect to the width and height directions. On the other hand, a locking projection 18 is formed on a surface of each mounting groove 15 to face the plate surface of the main portion 61. Each locking projection 18 is disposed and dimensioned to fit closely into the corresponding locking hole 68. Only one locking hole 68 is formed in each fixing portion 60 and is engageable with one corresponding locking projection 18.

The fixing portions 60 can be mounted into the mounting grooves 15 of the housing 10 by pressing the locking projections 18 of the housing 10 into the locking holes 68 of the fixing portions 60. At this time, the locking projection 18 and the locking hole 68 are engaged only at one position for one fixing portion 60. Thus, areas where the fixing portions 60 contact the housing 10 are reduced maximally. As a result, the influence of the thermal expansion of the housing 10 on the fixing portions 60 can be reduced, enabling the connected state of the fixing portions 60 to be kept satisfactorily.

The engaged positions of the locking projections 18 and the locking holes 68 are substantially in the widthwise centers of the fixing portions 60. Thus, the fixing portions 60 can be locked into the housing 10 in well-balanced postures. Further, the locking projections 18 expand outward due to the thermal expansion of the housing 10, thereby being brought into closer contact with the inner surfaces of the locking holes 68. Therefore, the fixing portions 60 are locked into the housing 10 with a stronger force.

Figure 7:
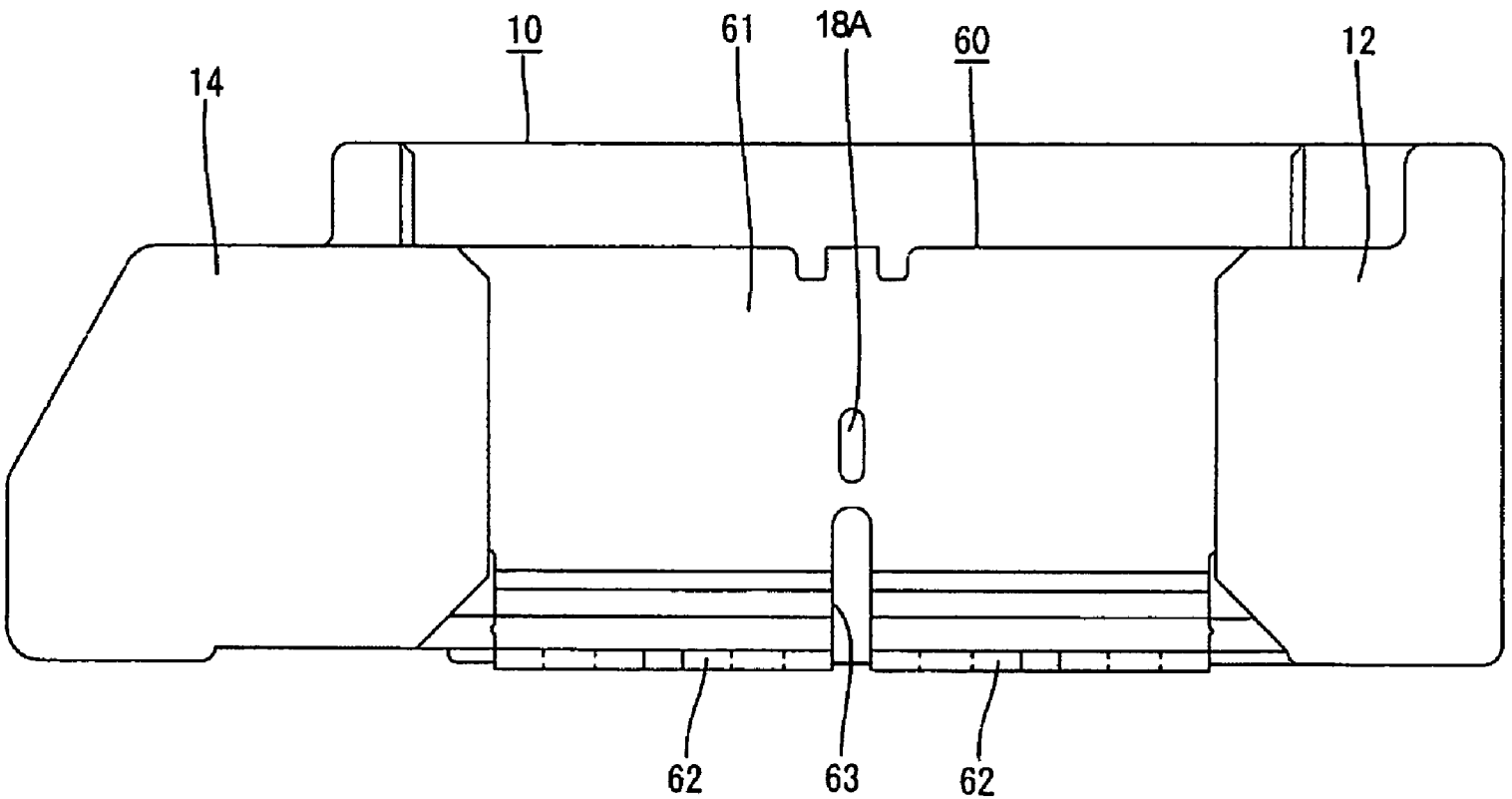
FIG. 7 is a side view showing another embodiment.

Contrary to the above, as shown in FIG. 7, a locking projection 18A may project in on each fixing portion 60 and a locking hole (not shown) may be formed in the surface of each mounting groove 15. The fixing portion 60 may be locked into the housing 10 by the engagement of the locking projection 18A and the locking hole.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

According to the invention, the fixing portions may be fixed by the known fixing means after soldering the fixing portions with the circuit board.

The terminal fittings are connected with the circuit board by soldering in the first and second embodiments. However, the invention is also applicable to a circuit board connector using press-fit terminals that are pressed into the circuit board for connection or insulation displacement terminal fittings that connect with conductors by insulation displacement. The terminal fittings need not be L-shaped, and may be straight forms or may have any other bent shape. The invention is also applicable to a circuit board connector, in a mating housing of which male terminal fittings are provided, wherein connector-side connecting portions are of the female type.

The contact positions of the retaining portions and the edges of the mounting grooves in the mounted state are spaced from the circuit board less than half the maximum height of the housing in the first embodiment. However, these contact positions may be exactly half the maximum height of the housing.

According to the invention, it is better to set the contact positions of the retaining portions and the edges of the mounting grooves maximally close to the circuit board and even lower than in the first embodiment to suppress the thermal displacements even more.

According to the invention, only one of the connection of the terminal fittings with the circuit board and that of the fixing portions with the circuit board may be done by reflow soldering, and the other may be done by manual soldering or the like.

A heat source for causing the thermal expansion of the housing is not limited to the reflow furnace, and the present invention is widely applicable in cases where the entire housing is exposed to an environment subject to temperature fluctuations.

Even though the invention has been described with respect to a connector mountable to a printed circuit board, it should be understood that the invention is applicable to other types of connectors mountable to electric or electronic devices such as flexible circuit boards, junction boxes, airbag devices, dashboard circuits, etc.

What is claimed is:

1. A connector, comprising:

a housing having a bottom surface mountable on an electric or electronic device and a top surface, at least one mounting groove extending from the top surface to the bottom surface, the mounting groove having a wide portion adjacent the top surface of the housing, a narrow portion between the wide portion and the bottom surface of the housing and a step between the wide and narrow portions of the mounting groove;

at least one metal fixing portion mounted in the mounting groove on the housing, the metal fixing portion having opposite top and bottom ends, a solder portion at the bottom end of the metal fixing portion and connected with the device by soldering, a wide portion adjacent the top end of the fixing portion and disposed in the wide portion of the mounting groove, an intermediate portion between the wide portion of the fixing portion and the bottom end of the fixing portion, the intermediate portion being disposed in the narrow portion of the mounting groove, a step formed on the fixing portion between the wide and narrow portions thereof, the step of the fixing portion engaging the step between the wide and narrow portions of the mounting groove; and displacement restricting means formed on the narrow portion of the fixing portion for biting into the housing at the narrow portion of the mounting groove for keeping the fixing portion soldered to the device against a separating force acting on the fixing portion in a direction away from the device as the housing thermally expands, whereby the fixing portion is inserted downwardly into the mounting groove and towards the bottom surface of the housing until the step of the fixing portion contacts the step of the mounting groove for stopping the downward insertion of the fixing portion when the solder portion substantially aligns with the bottom surface of the housing.

2. The connector of claim 1, wherein the displacement restricting means comprises a retainer formed on the fixing portion for biting an edge of the mounting groove and preventing the fixing portion from coming out of the mounting groove.

3. The connector of claim 2, wherein a contact position of the retaining portion and the edge of the mounting groove in a mounted state of the fixing portion is spaced from the device a distance that is substantially equal to or less than about half the maximum height of the housing with respect to a direction away from the device.

4. The connector of claim 3, wherein the contact position of the retaining portion and the edge of the mounting groove in the mounted state is in proximity to the device.

5. The connector of claim 1, wherein the displacement restricting means comprises at least one lock on the housing and at least one engaging portion on the fixing portion, wherein the fixing portion can be locked into the housing by engagement of the lock, and the engaging portion.

6. The connector of claim 5, wherein the engaging portion and the lock are engaged only at one position on the fixing portion.

7. The connector of claim 5, wherein the engaging portion and the lock are substantially at a widthwise center of the fixing portion.

8. The connector of claim 5, wherein the engaging portion comprises a locking hole penetrating the fixing portion, and the lock comprises a locking projection fittable into the locking hole.

9. The connector of claim 1, wherein the fixing portion has a diverging configuration gradually becoming larger towards a rear part as seen in a mounting direction of the fixing portion to the housing.

10. The connector of claim 1, wherein the housing is made of a liquid crystal polymer or a polyphenylene sulfide.

11. A connector, comprising:

a housing having a bottom surface mountable on an electric or electronic device and a top surface spaced from the bottom surface along a height direction to define a height, the housing having opposite first and second side surfaces extending between the top and bottom surfaces, first and second mounting grooves formed respectively at the first and second side surfaces of the housing, each of said mounting grooves having a wide portion adjacent the top surface of the housing and a narrow portion between the wide portion and the bottom surface of the housing, an upwardly facing step being defined between the wide and narrow portions of each said mounting groove; and first and second metal fixing portions mounted respectively in the first and second mounting grooves of the housing each of said fixing portions having opposite top and bottom ends, a solder portion being formed at the bottom end of each of said fixing portion, the solder portion being aligned with the bottom surface of the housing and connected with the device by soldering, a wide portion substantially adjacent the top end of the fixing portion and disposed in the wide portion of mounting groove, an intermediate portion disposed in the narrow portion of the mounting groove, a step defined between the intermediate portion and the wide portion of the fixing portion and engaging the step in the mounting groove, at least one retainer formed on the intermediate portion of each of said fixing portions and engaging the housing at a location in the narrow portion of the mounting groove spaced from the bottom surface of the housing by a distance less than half the height of the housing, the fixing portions being aligned for resisting thermal expansion of the housing away from the device for keeping the fixing portion soldered to the device against a separating force acting on the fixing portion in a direction away from the device as the housing thermally expands, whereby the fixing portion is inserted downwardly into the mounting groove and towards the bottom surface of the housing until the step of the fixing portion contacts the step of the mounting groove for stopping the downward insertion of the fixing portion when the solder portion substantially aligns with the bottom surface of the housing.

12. The connector of claim 11, wherein the at least one retainer comprises two retainers formed on each of said fixing portions for biting an edge of the respective mounting groove and preventing the fixing portion from coming out of the respective mounting groove.

13. The connector of claim 11, further comprising first and second locks formed respectively on the first and second sides of the housing and wherein the at least one retainer comprises an engaging portion on each of said the fixing portions for engaging the corresponding lock.

14. The connector of claim 13, wherein the engaging portion and the lock are substantially at a widthwise center of the fixing portion.

15. The connector of claim 14, wherein the engaging portion comprises a locking hole penetrating the fixing portion, and the lock comprises a locking projection fittable into the locking hole.

* * * * *